US011235915B2

(12) United States Patent
Kim

(10) Patent No.: US 11,235,915 B2
(45) Date of Patent: Feb. 1, 2022

(54) CONTAINER FOR DISCHARGING CONTENTS

(71) Applicant: YONWOO CO., LTD., Incheon (KR)

(72) Inventor: Min-Goo Kim, Incheon (KR)

(73) Assignee: YONWOO CO., LTD., Incheon (KR)

( * ) Notice: Subject to any disclaimer, the term of this patent is extended or adjusted under 35 U.S.C. 154(b) by 0 days.

(21) Appl. No.: 17/140,799

(22) Filed: Jan. 4, 2021

(65) Prior Publication Data

US 2021/0206542 A1 Jul. 8, 2021

(30) Foreign Application Priority Data

Jan. 3, 2020 (KR) ..... 10-2020-0000746

(51) Int. Cl.
*B65D 47/18* (2006.01)

(52) U.S. Cl.
CPC ..... *B65D 47/18* (2013.01)

(58) Field of Classification Search
CPC ..... B65D 47/18; B01L 3/00; B01L 3/0082
USPC ..... 222/420; 141/23, 24
See application file for complete search history.

(56) References Cited

U.S. PATENT DOCUMENTS 4,579,153 A * 4/1986 Goncalves ..... B01L 3/0282 141/23
9,731,880 B2 * 8/2017 Choi ..... B65D 51/32
2013/0112314 A1 * 5/2013 Lee ..... A45D 40/267 141/23
2014/0020789 A1 * 1/2014 Duquet ..... A45D 34/04 141/24
2017/0006999 A1 * 1/2017 Moon ..... A45D 34/04

FOREIGN PATENT DOCUMENTS

| | | | |
|---|---|---|---|
| EP | 2912965 | A1 | 9/2015 |
| JP | 05-019154 | U | 3/1993 |
| JP | 2004-231229 | A | 8/2004 |
| KR | 10-2011-0133700 | A | 12/2011 |
| KR | 10-2012-0014653 | A | 2/2012 |
| KR | 10-2013-0060742 | A | 6/2013 |

* cited by examiner

*Primary Examiner* — Lien M Ngo
(74) *Attorney, Agent, or Firm* — Novick, Kim & Lee, PLLC; Sang Ho Lee; Hyun Woo Shin

(57) ABSTRACT

The container for discharging contents includes a container body, in which contents are accommodated, and a dropper portion detachably coupled to an upper portion of the container body and configured to suction and discharge the contents in the container body, wherein the dropper portion includes: an inner cap detachably coupled to the upper portion of the container body; a pipette portion coupled to the inner cap to communicate with an inside of the inner cap and having at least part thereof accommodated in the container body to suction the contents; a pressing portion configured to discharge the contents suctioned into the pipette portion by pressing; and a button portion including an elastic member which is formed under the pressing portion to be disposed inside the inner cap and provides an elastic force to the pressing portion, wherein the elastic member is accommodated in an uncompressed state in the inner cap.

10 Claims, 10 Drawing Sheets

CONTAINER FOR DISCHARGING CONTENTS

CROSS-REFERENCE TO RELATED APPLICATION

This application claims priority under 35 USC 119 to Korean Patent Application No. 10-2020-0000746, filed on Jan. 3, 2020, the disclosure of which is incorporated herein by reference in its entirety.

BACKGROUND

1. Field of the Invention

The present disclosure relates to a container for discharging contents, and more particularly, to a container for discharging contents which allows a certain amount of contents to be withdrawn and used only by separating a dropper portion.

2. Discussion of Related Art

In general, according to the related art, a method of individually packaging in the form of capsules, etc., as much as the amount to be used for each use has been used as a method of using liquid contents such as cosmetics, which are desirable to be used a small amount at a time but accurately quantified. However, such an individual packaging method has a problem that a relatively large amount remains inside a capsule even after a user uses contents and is extremely inefficient.

In order to overcome the problem of the individual packaging method, a configuration has been devised to store contents in a container and then to use a pipette-structured withdrawal part or a pressing pump as a withdrawal part.

However, in the case of a simple pipette-structured withdrawing part according to the related art, since the amount of a cosmetic that is suctioned and withdrawn varies depending on the degree to which the user presses a compressing portion made of rubber or the like, there is a problem that it is not easy to accurately withdraw a certain amount each time it is used.

On the other hand, even in the case of using the pressing pump, there is a problem that the capacity of contents drawn out may vary due to the degree of pressure of the user on a nozzle or contents remaining in the nozzle. In addition, the pressing pump includes a spring made of a metal material that provides an elastic force into the pressing pump so as to perform repeated pumping operations. Thus, the overall manufacturing cost increases, and the spring is not easy to recycle because the spring should be separated from other components to dispose of the spring.

Therefore, a technique for solving this problem is required.

SUMMARY OF THE INVENTION

The present disclosure is directed to a container for discharging contents in which contents stored in a container body are suctioned into a pipette portion according to separation of a dropper portion so that a certain amount of contents can be simply withdrawn and used without a separate operation.

The present disclosure is also directed to a container for discharging contents including an elastic member made of a plastic material.

Technical solutions to be solved by the present disclosure are not limited to the above-described problem, and other technical solutions that are not mentioned will be clearly understood by those of ordinary skill in the art from the present specification and the accompanying drawings.

According to an aspect of the present disclosure, there is provided a container for discharging contents including a container body configured to accommodate contents therein, and a dropper portion detachably coupled to an upper portion of the container body and configured to suction and discharge the contents in the container body, wherein the dropper portion includes an inner cap detachably coupled to the upper portion of the container body, a pipette portion coupled to the inner cap to communicate with an inside of the inner cap and having at least a part thereof accommodated in the container body to suction the contents, a pressing portion configured to discharge the contents suctioned into the pipette portion by pressing, and a button portion including an elastic member, wherein the elastic member is formed under the pressing portion to be disposed inside the inner cap and provides an elastic force to the pressing portion, and wherein the elastic member is accommodated in an uncompressed state in the inner cap and integrally lifted with the pressing portion from the inside of the inner cap according to separation of the dropper portion and at least a part of the pressing portion protrudes outward due to the lifting of the pressing portion.

At least a part of the button portion may be made of a soft plastic material, and the pressing portion and the elastic member may be integrally formed.

A cylinder portion that communicates with the pipette portion may be formed inside the inner cap, and the dropper portion may further include a seal cap that is coupled to the button portion, is pressed against an inner circumferential surface of the cylinder portion and is lifted or lowered according to the separation or coupling of the dropper portion to change an internal pressure of the cylinder portion.

The dropper portion may further include an outer cap that is coupled to surround the inner cap and rotates integrally with the button portion, at least one lifting protrusion may be formed on the button portion, at least one guide groove, into which the at least one lifting protrusion is inserted, may be formed to pass through the inner cap along an outer circumferential surface thereof, and when the outer cap is rotated in a first direction or a second direction opposite to the first direction in order to separate or couple the dropper portion from or to the container body, the at least one lifting protrusion may move along the at least one guide groove and the button portion is lifted or lowered.

The elastic member may include an upper support connected to the pressing portion, a lower support provided under the upper support, and at least one elastic portion connecting the upper support and the lower support with a certain inclination and is bent and deformed when the pressing is performed on the pressing portion.

The at least one lifting protrusion may be formed on the lower support or on each of the lower support and the upper support.

When a user presses the pressing portion to discharge the contents, the lower support may be supported by the at least one lifting protrusion and the at least one guide groove and the elastic member provides the elastic force to the pressing portion.

A vertical groove may be formed on an inner surface of the outer cap in a vertical direction, and an end of the at least one lifting protrusion passing through the at least one guide groove may be coupled to the vertical groove and a rotational force of the outer cap is transmitted to the button portion.

When the at least one lifting protrusion comes into contact with an end of the at least one guide groove in the first direction according to a rotation of the outer cap in the first direction, the inner cap may be rotated together with the outer cap in the first direction and may be separated from the container body.

When the at least one lifting protrusion comes into contact with an end of the at least one guide groove in the second direction according to a rotation of the outer cap in the second direction, the inner cap may be rotated together with the outer cap in the second direction and may be coupled to the container body.

As the inner cap is rotated together with the outer cap in the second direction, the inner cap may be coupled to the container body, and at least one limiting protrusion may be formed on an inner lower end of the inner cap, and at least one limiting jaw may be formed on an upper surface of the container body, and when a lower end of the inner cap becomes closer to the upper surface of the container body at a certain interval, the at least one limiting protrusions may be caught by the at least one limiting jaw and the rotation of the outer cap and the inner cap in the second direction is limited.

Advantageous Effects

According to the present disclosure, the container for discharging contents is configured to suction contents stored in a container body into a pipette portion so that a certain amount of the contents can be simply withdrawn and used without a separate operation and thus the convenience of use can further be increased.

In addition, according to the present disclosure, an elastic member made of a plastic material is applied so that cost can be reduced through a simple structure and the problem of separation and disposal from other components can be solved and thus is eco-friendly.

Furthermore, according to the present disclosure, the elastic member is accommodated inside the dropper portion without deformation and then is lifted integrally with a button portion only when the dropper portion is used to be separated and is compressed and deformed according to pressure applied by the user so that the restoring force of the elastic member made of a plastic material can be prevented from decreasing when the elastic member is kept and carried in a container.

BRIEF DESCRIPTION OF THE DRAWINGS

The above and other objects, features and advantages of the present disclosure will become more apparent to those of ordinary skill in the art by describing exemplary embodiments thereof in detail with reference to the accompanying drawings, in which.

DETAILED DESCRIPTION OF EXEMPLARY EMBODIMENTS

Figure 1:
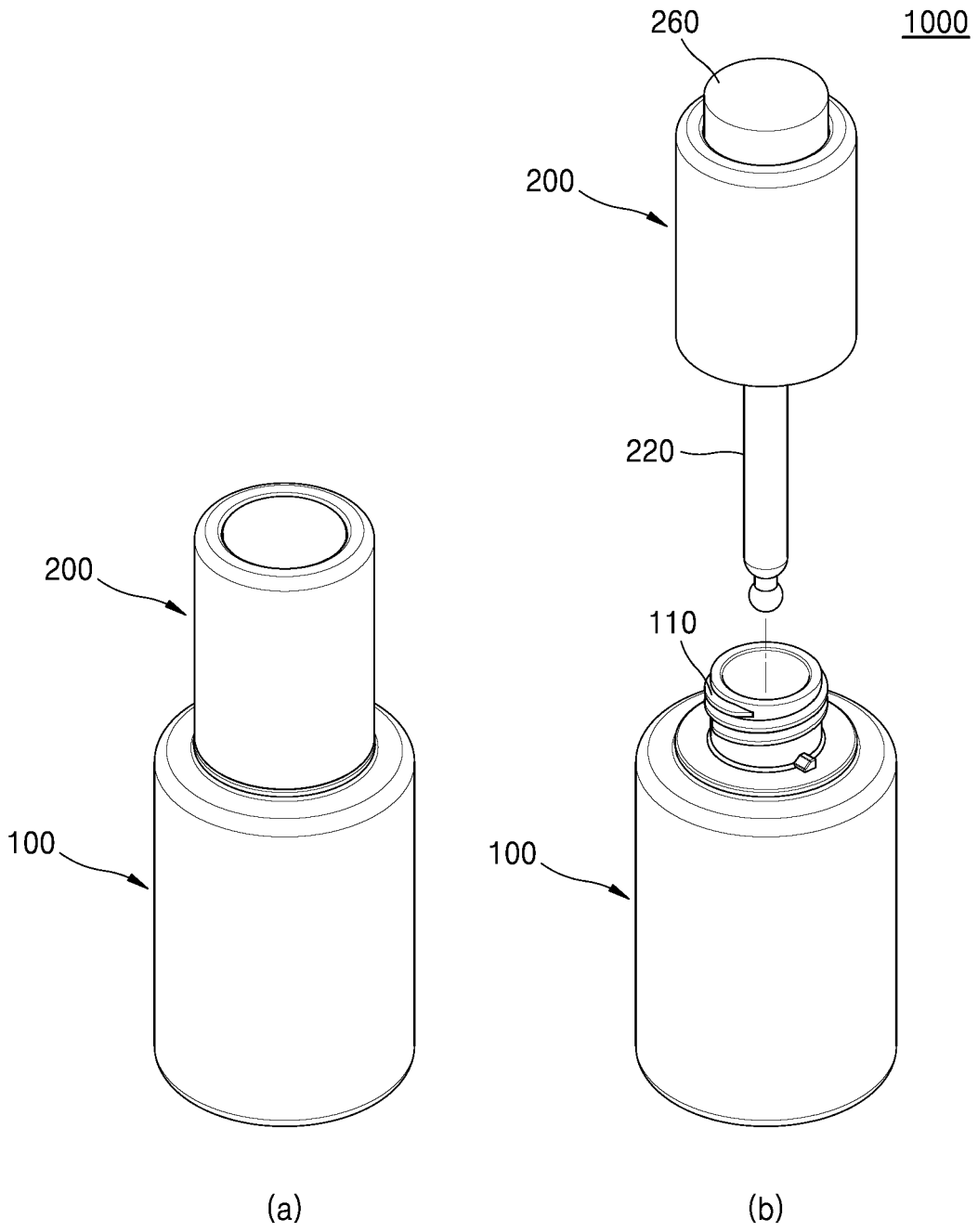
FIG. 1 is a perspective view of a container for discharging contents according to an embodiment of the present disclosure.

Hereinafter, embodiments of the present disclosure will be described with reference to the accompanying drawings. When adding reference numerals to elements of each drawing, it should be noted that the same reference numerals are assigned to the same elements even if the same elements are indicated on different drawings. In addition, in the description of the embodiment of the present disclosure, when it is determined that a detailed description of a related known configuration or function interferes with an understanding of the embodiment of the present disclosure, the detailed description thereof will be omitted. Also, the embodiments of the present disclosure will be described below, but the technical spirit of the present disclosure is not restricted or limited thereto and may be modified and variously implemented by those skilled in the art. Meanwhile, for convenience of the following description, up, down, left, and right directions are based on the drawings, and the scope of the present disclosure is not necessarily limited to a corresponding direction.

Throughout the specification, when a part is said to be "connected" to another part, this includes not only "directly connected" to another part but also "indirectly connected" to another part with still another part interposed therebetween. Throughout the specification, when a part "includes" a certain component, it means that other components may further be included rather than excluding other components unless otherwise stated. In addition, in describing components of the embodiment of the present disclosure, terms such as first, second, A, B, (a), and (b) may be used. These terms are only for distinguishing the component from other components, and the nature, sequence, or order of the components is not limited by the terms.

Figure 2:
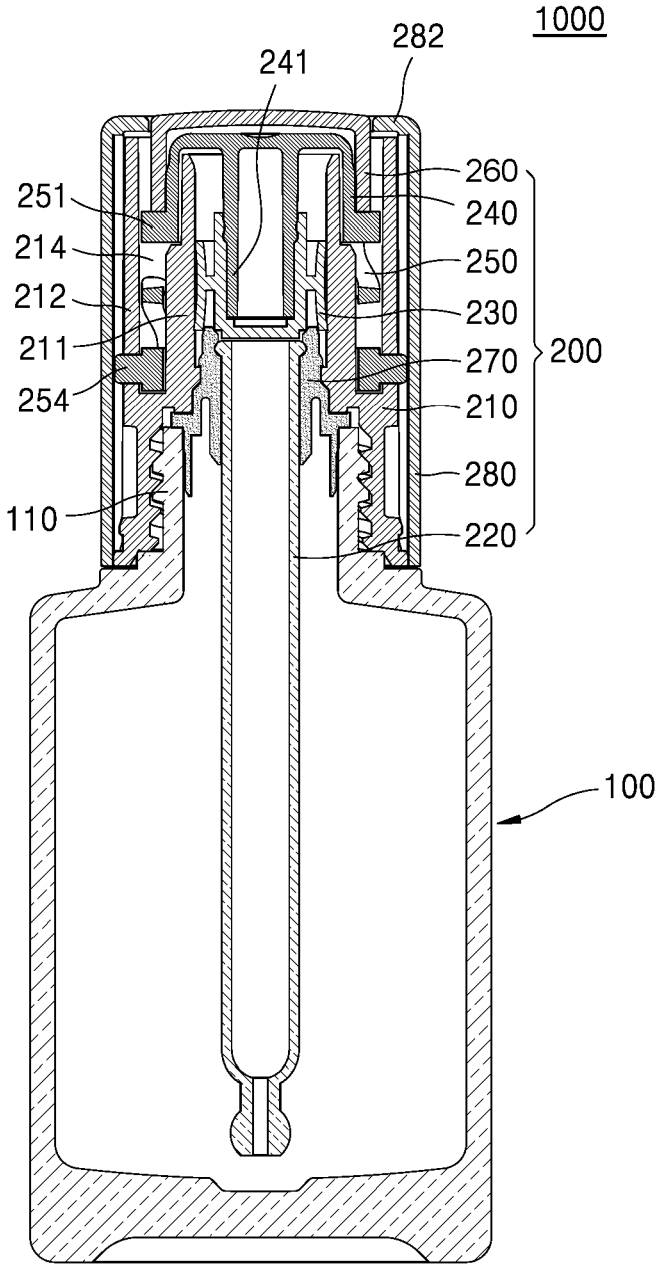
FIG. 2 is a cross-sectional view of a container for discharging contents according to an embodiment of the present disclosure.
Figure 3:
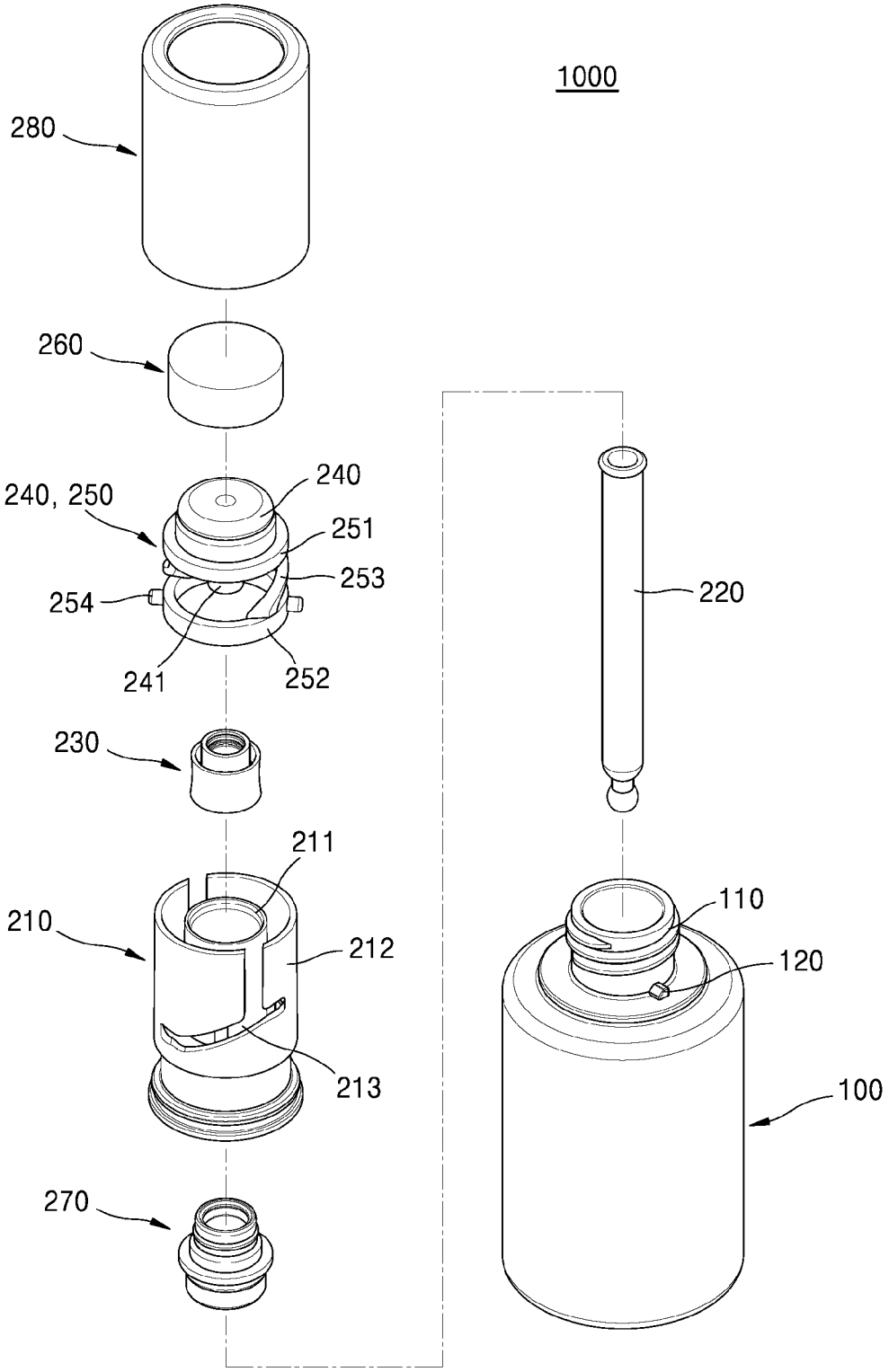
FIG. 3 is an exploded perspective view of a container for discharging contents according to an embodiment of the present disclosure.
Figure 4:
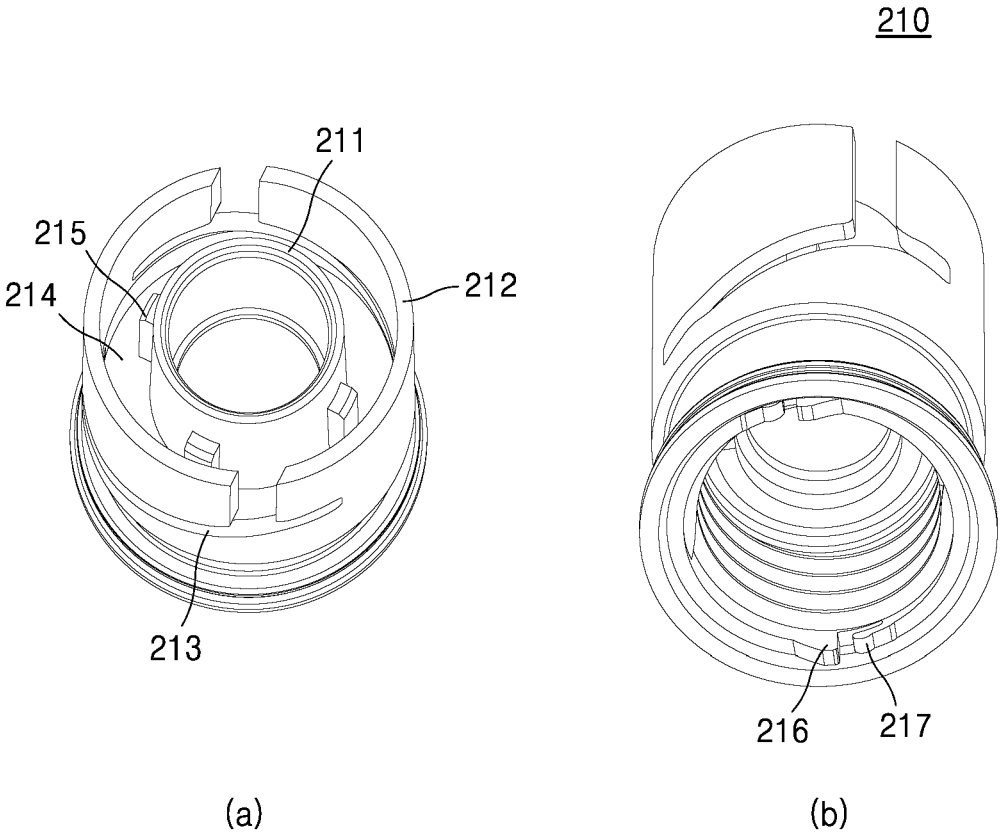
FIG. 4 is a perspective view for describing an inner cap of a container for discharging contents according to an embodiment of the present disclosure.
Figure 5:
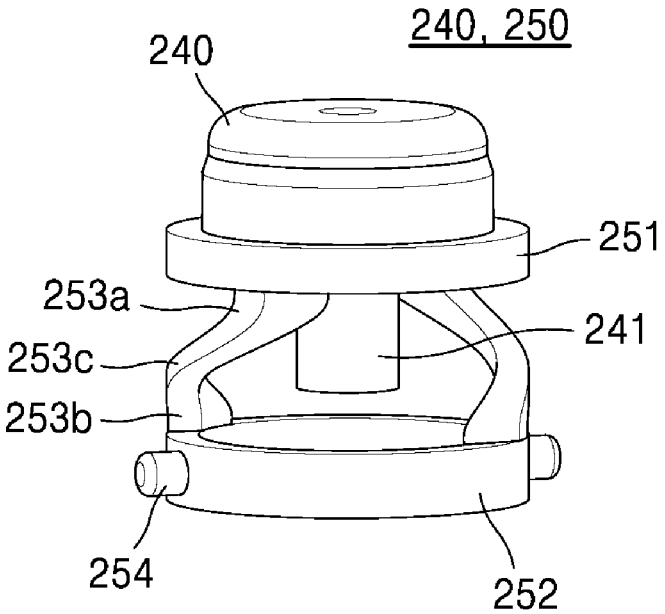
FIG. 5 is a perspective view for describing a button portion of a container for discharging contents according to an embodiment of the present disclosure.
Figure 6:
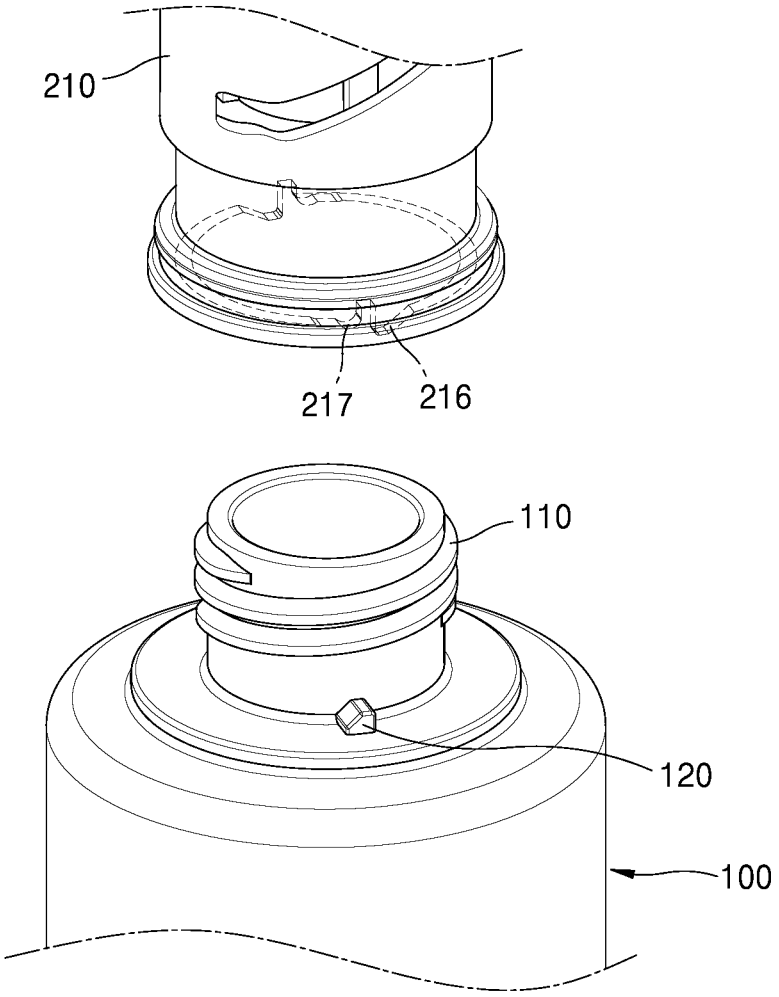
FIG. 6 illustrates the coupling relationship between the inner cap and a container body of a container for discharging contents according to an embodiment of the present disclosure.
Figure 7:
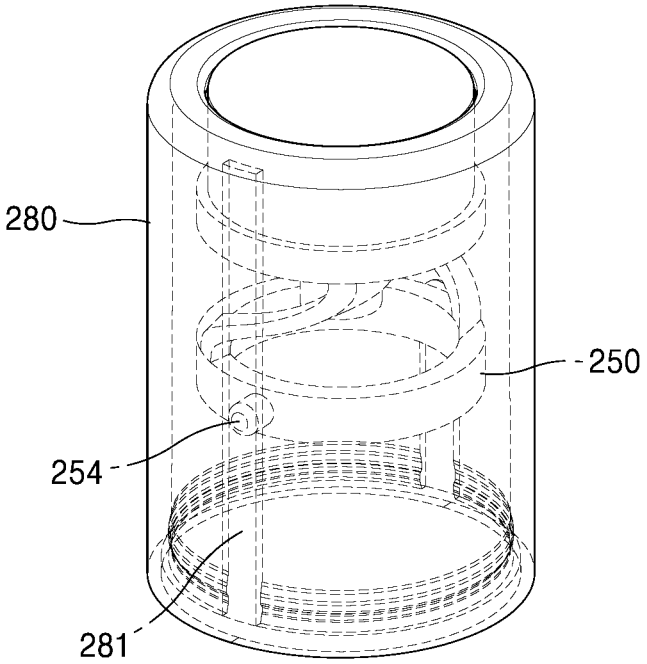
FIG. 7 illustrates the coupling relationship between the button portion and an outer cap of a container for discharging contents according to an embodiment of the present disclosure.

FIG. 1 is a perspective view of a container for discharging contents according to an embodiment of the present disclosure, FIG. 2 is a cross-sectional view of a container for discharging contents according to an embodiment of the present disclosure, FIG. 3 is an exploded perspective view of a container for discharging contents according to an embodiment of the present disclosure, FIG. 4 is a perspective view for describing an inner cap of a container for discharging contents according to an embodiment of the present disclosure, FIG. 5 is a perspective view for describing a button portion of a container for discharging contents according to an embodiment of the present disclosure, FIG. 6 illustrates the coupling relationship between the inner cap and a container body of a container for discharging contents according to an embodiment of the present disclosure, and FIG. 7 illustrates the coupling relationship between the button portion and an outer cap of a container for discharging contents according to an embodiment of the present disclosure.

Referring to FIGS. 1 through 7, a container for discharging contents according to the embodiment of the present disclosure may include a container body 100 and a dropper portion 200.

The container body 100 may provide an accommodation space in which contents are accommodated. The contents accommodated in the container body 100 may be suctioned and discharged by a pipette portion 220 of the dropper portion 200 and used by a user. Here, the contents that are a liquid or gel-like fluid may be quasi-drugs such as cosmetics, pharmaceuticals, or toothpaste, but are not limited thereto and may encompass all kinds of substances that can be suctioned and discharged through the pipette portion 220. In addition, although an example of the container body 100 is shown as a bottle type, various types of the container body 100, such as a tube, may be applied.

A discharge portion 110 with an open end may be formed in an upper center of the container body 100. The pipette portion 220 may be inserted into the discharge portion 110, and the dropper portion 200 may be detachably coupled to the discharge portion 110. To this end, a screw thread for screw-coupling may be formed on the outer surface of the discharge portion 110.

The dropper portion 200 may be detachably coupled to an upper portion of the container body 100 (especially, the discharge portion 110) and may quantitatively suction and discharge the contents stored in the container body 100 to the outside. The dropper portion 200 may include an inner cap 210, a pipette portion 220, a seal cap 230, button portions 240 and 250, a button cap 260, a coupling portion 270, and an outer cap 280.

The inner cap 210 is a configuration for supporting other components and guiding lifting and lowering motions of the button portions 240 and 250 described below and may be screw-coupled to the discharge portion 110 of the container body 100. To this end, a screw thread corresponding to the screw thread of the discharge portion 110 may be formed on a lower inner circumferential surface of the inner cap 210.

A cylinder portion 211 may be formed inside the inner cap 210. The cylinder portion 211 may communicate with the pipette portion 220 and may allow the contents to be suctioned into the pipette portion 220 according to changes in the internal pressure, or the contents suctioned to the outside may be discharged.

In addition, a rim portion 212 that at least partially surrounds the cylinder portion 211 may be formed to be spaced apart from the inner cap 210 along the circumference of the cylinder portion 211, and a guide groove 213 may be formed to pass through the inner cap 210 along the outer circumferential surface of the rim portion 212 to a predetermined length. The guide groove 213 may guide lifting or lowering of the button portions 240 and 250 by inserting lifting protrusions 254 of the button portions 240 and 250.

An accommodation space 214, in which elastic members 250 of the button portions 240 and 250 are accommodated, may be formed to pass through the spaced gap between the cylinder portion 211 and the rim portion 212. For example, the elastic members 250 may be accommodated in a form surrounding the cylinder portion 211 in the accommodation space 214. In one embodiment, at least one spacing protrusion may extend in a vertical direction so as to support the elastic members 250 from the inside and to separate inner circumferential surfaces of the elastic members 250 from the cylinder portion 211 by a predetermined distance for deformation of the elastic members 250 and may be arranged to be spaced apart from each other at regular intervals along the outer peripheral surface of the cylinder portion 211.

In addition, one or more limiting protrusions 216 and 217 may be formed on an inner lower end of the inner cap 210. The limiting protrusions 216 and 217 are caught by limiting jaws 120 formed on the upper surface of the container body 100 so that the inner cap 210 can be prevented from being randomly rotated in a first direction by an unintended external force and separated from the container body 100 or can be prevented from being excessively rotated in a second direction opposite to the first direction.

In one embodiment, the limiting protrusions 216 and 217 may be configured as a pair of a first protrusion 216 and a second protrusion 217 having different heights. In this case, one or more pairs of limiting protrusions 216 and 217 may be formed at different positions of the inner lower end of the inner cap 210, and correspondingly, the limiting jaws 120 may also be formed at different positions of the upper surface of the container body 100.

The first protrusion 216 may limit the rotation of the inner cap 210 in the second direction. For example, as described below, when the inner cap 210 is rotated in the second direction together with the outer cap 280, the inner cap 210 is coupled to the discharge portion 110 of the container body 100, and in the process of screw-coupling, the lower end of the inner cap 210 may become closer to the upper surface of the container body 100. When the lower end of the inner cap 210 becomes closer to the upper surface of the container body 100 at a certain interval, a vertical surface formed on one side of the first protrusion 216 of the inner cap 210 is pressed against a vertical surface of each of the limiting jaws 120 of the container body 100 so that the rotation of the inner cap 210 in the second direction can be limited. This is to prevent damage to the button portions 240 and 250 by applying an excessive force to the lifting protrusions 254 of the button portions 240 and 250 that provide a rotational force with respect to the inner cap 210.

The second protrusion 217 may be formed to be spaced apart from the first protrusion 216 to limit the rotation of the inner cap 210 in the first direction. For example, in a state in which the inner cap 210 is completely coupled to the discharge portion 110 of the container body 100, the limiting jaws 120 may be located between the first protrusion 216 and the second protrusion 217. In this case, the end of the second protrusion 217 is formed in a smooth curved surface so that the inner cap 210 can be rotated in the first direction only when the second protrusion 217 comes into contact with an inclined surface of each of the limiting jaws 120 and a predetermined or more rotational force is applied in the first direction. Accordingly, the inner cap 210 can be prevented from being separated by arbitrary rotation in the first direction by an unintended external force.

The pipette portion 220 is formed to have a discharge hole (not shown) by opening a lower end of the pipette portion 220, and the upper end of the pipette portion 220 communicates with the cylinder portion 211 of the inner cap 210, and the pipette portion 220 may suction and discharge the contents contained in the container body 100 according to changes in the pressure of the cylinder portion 211. For example, when the container body 100 and the dropper portion 200 are coupled to each other, at least a part of the pipette portion 220 may be accommodated in the container body 100 through the discharge portion 110. Thereafter, when a negative pressure is formed in the cylinder portion 211 according to a rotation operation for separating the dropper portion 200, the contents may be suctioned from the container body 100. In addition, when the dropper portion 200 is completely separated from the container body 100, the pipette portion 220 is withdrawn from the container body 100, and when a positive pressure is formed inside the cylinder portion 211 according to the pressing of the button portions 240 and 250, the suctioned contents can be discharged to the outside.

The seal cap 230 is disposed inside the cylinder portion 211, and in a state in which the seal cap 230 is pressed against the inner circumferential surface of the cylinder portion 211, the seal cap 230 may also be lifted or lowered so that the internal pressure of the cylinder portion 211 can be changed. For example, the seal cap 230 is coupled to a rod portion 241 of the button portions 240 and 250 and is configured to be lifted or lowered together with the button portions 240 and 250 according to the rotation operation for separation and coupling of the dropper portion 200.

The button portions 240 and 250 are coupled to surround the cylinder portion 211 on the inner upper portion of the inner cap 210, and in the process of separating or coupling the dropper portion 200, the button portions 240 and 250 are rotated together with the outer cap 280 in the first direction or the second direction so that the button portions 240 and 250 can be lifted or lowered from the inside of the inner cap 210. In addition, when the dropper portion 200 is separated from the container body 100, at least a part of the button portions 240 and 250 may be exposed to the outside, and the contents suctioned into the pipette portion 220 may be discharged according to pressure applied by the user.

The button portions 240 and 250 may include a pressing portion 240 and an elastic member 250.

At least a part of the pressing portion 240 is exposed to the outside during the separation process of the dropper portion 200, and the seal cap 230 coupled thereto is lifted so that the contents of the container body 100 can be suctioned into the pipette portion 220. In addition, the dropper portion 200 is completely separated from the container body 100 and then is pressed by the user so that the contents of the pipette portion 220 can be discharged.

The rod portion 241 may extend downward from the inner upper surface of the pressing portion 240. Since the end of the rod portion 241 is insertion-coupled to the seal cap 230, the seal cap 230 and the pressing portion 240 may be coupled to each other.

The elastic member 250 may be formed under the pressing portion 240 to provide an elastic force to the pressing portion 240. When the pressing portion 240 is pressed by the user, the pressing portion 240 is lowered while the elastic member 250 is deformed, and when the pressing portion 240 is released, the pressing portion 240 can be restored to its original location by the elastic force of the elastic member 250.

The elastic member 250 may include an upper support 251, a lower support 252 provided under the upper support 251, and at least one elastic portion 253 connecting the upper support 251 and the lower support 252.

The upper support 251 may be coupled to the pressing portion 240 and may support the upper end of the elastic portion 253. When the upper support 251 is lowered when pressing against the pressing portion 240, the pressure may be transmitted to the elastic portion 253, and when the pressure is released, the upper support 251 may be lifted by the elastic force of the elastic portion 253 and may be restored.

A lower support 252 may be provided under the upper support 251. The lower support 252 may support the lower end of the elastic portion 253. The lower support 252 is not lifted and supports the elastic portion 253 so that the elastic force of the elastic portion 253 is directed toward the upper support 251.

The upper support 251 and the lower support 252 each have a hollow formed therein so that the rod portion 241 of the pressing portion 240 is located inside the upper support 251 and/or the lower support 252. For example, the upper support 251 and the lower support 252 may have a circular ring shape.

The elastic portion 253 may connect the upper support 251 and the lower support 252 with a predetermined inclination. When the elastic member 250 is pressed, the elastic portion 253 may be bent and deformed to generate an elastic force (i.e., elastic compression). When the pressure on the elastic member 250 is released, bending deformation is also released, and the elastic portion 253 may be restored to its original state.

In one embodiment, the elastic portion 253 may be configured as at least one elastic portion. In addition, in an embodiment, the elastic force and the restoring force of the elastic member 250 may be adjusted by adjusting the stiffness and thickness of at least a part of the elastic portion 253.

At least a part of the button portions 240 and 250, in particular, the elastic member 250, may be made of a soft plastic material. In one embodiment, the button portions 240 and 250 may be integrally formed so that the pressing portion 240 and the elastic member 250 are made of the same material through injection molding.

According to an embodiment, the pressing portion 240, the upper support 251, the lower support 252, and the elastic portion 253 of the elastic member 250 may be made of different materials. In addition, according to the embodiment, the pressing portion 240, the upper support 251, the lower support 252, and the elastic portion 253 of the elastic member 250 may be assembled in a plurality of components.

At least one lifting protrusion 254 for separating or coupling the dropper portion 200 from or to the container body 100 and lifting or lowering the button portions 240 and 250 may be formed on the button portions 240 and 250. In one embodiment, the lifting protrusions 254 may be formed along the outer circumferential surface of the lower support 252. For example, the lifting protrusions 254 may be formed on opposite sides of the lower support 252, respectively.

The lifting protrusions 254 are each inserted into at least one guide groove 213 formed in the inner cap 210, and when the outer cap 280 is rotated in the first direction or the second direction opposite to the first direction in order for the user to separate or couple the dropper portion 200, the lifting protrusions 254 move along the guide groove 213 so that the button portions 240 and 250 can be integrally lifted or lowered.

The button cap 260 has a lower end that is open and may be coupled to the upper side of the pressing portion 240 to surround the pressing portion 240. According to an embodiment, a coupling protrusion and/or a coupling groove may be formed on the inner peripheral surface of the button cap 260 and/or the outer peripheral surface of the pressing portion 240 for mutual coupling. In addition, according to an embodiment, the button cap 260 may not be separately provided, and the upper portion of the pressing portion 240 may be exposed to the outside and directly pressed by the user, or the button cap 260 may be formed integrally with the pressing portion 240.

The coupling portion 270 may couple the pipette portion 220 to the inner cap 210 so as to communicate with the cylinder portion 211 and may simultaneously seal the lower part of the cylinder portion 211. For example, the coupling portion 270 may have a through hole (not shown) formed in the central portion, and the upper end of the pipette portion 220 may be fixedly inserted thereinto. In this state, the coupling portion 270 may be insertion-coupled to the inside of the cylinder portion 211 so that the upper end of the pipette portion 220 can communicate with the cylinder portion 211.

The outer cap 280 is coupled to surround the inner cap 210 and may rotate according to user manipulation. By rotating the button portions 240 and 250 and/or the inner cap 210 together with the outer cap 280, the dropper portion 200 is separated from or coupled to the container body 100.

A vertical groove 281 having a predetermined length in the vertical direction may be formed in the inner surface of the outer cap 280. The end of the lifting protrusion 254 passing through the guide groove 213 of the inner cap 210 is coupled to this vertical groove 281 so that the rotational force for the outer cap 280 is transmitted to the button portions 240 and 250 and thus, the button portions 240 and 250 may rotate together with the outer cap 280. In addition, an annular locking protrusion 282 may be formed on the upper end of the outer cap 280 to limit the detachment and lifting height of the button portions 240 and 250 inward.

Figure 8:
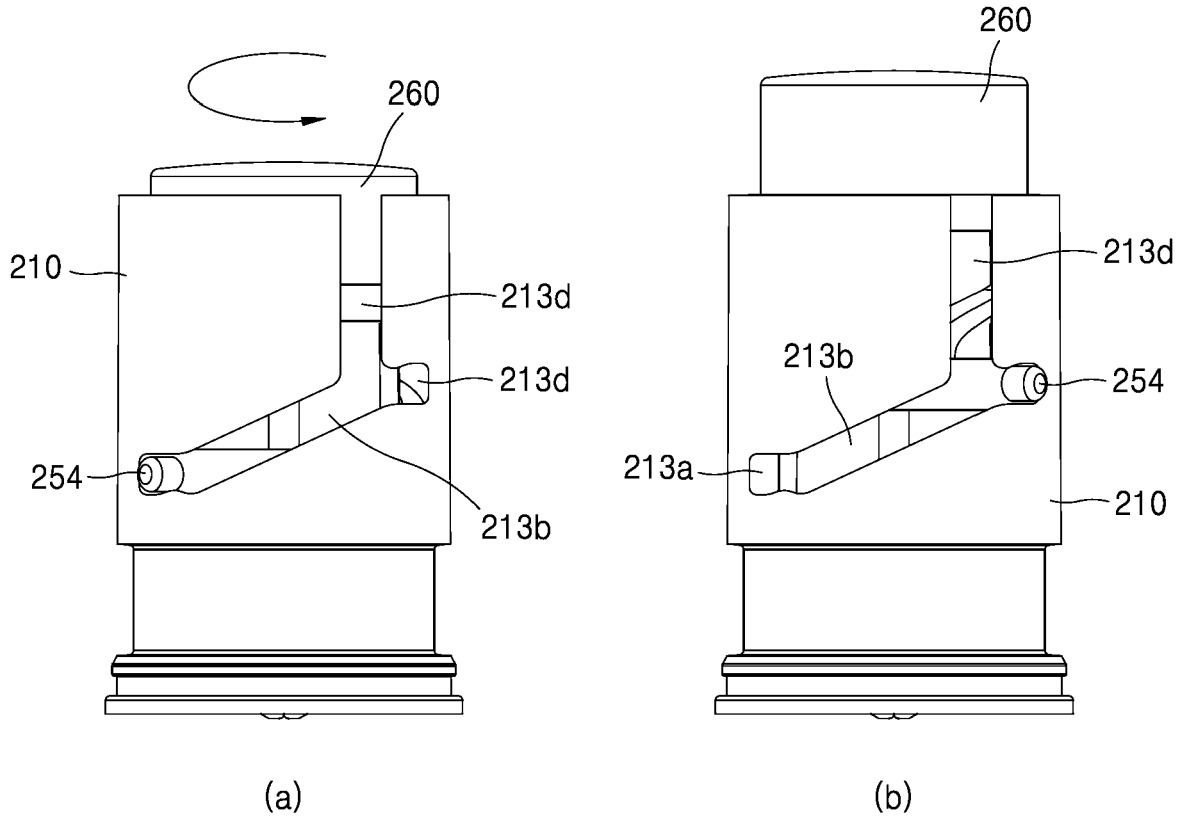
FIGS. 8 and 9 illustrate an exemplary operation of a container for discharging contents according to an embodiment of the present disclosure.
Figure 9:
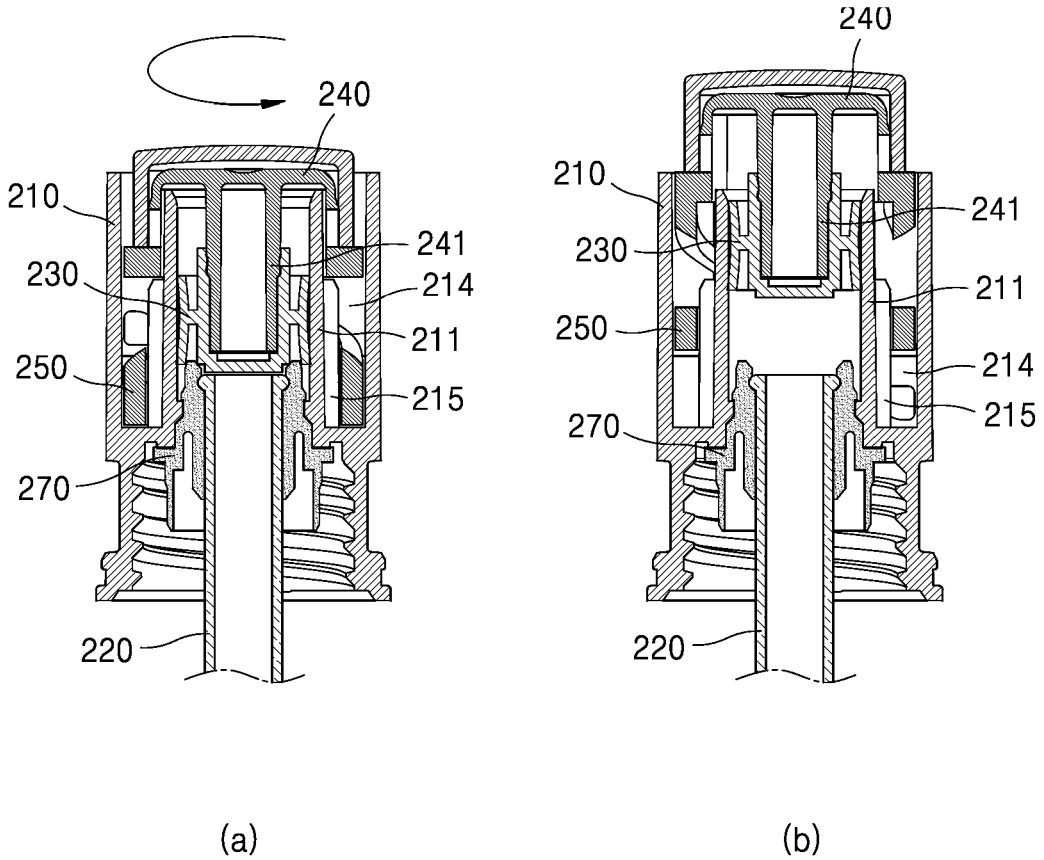

FIGS. 8 and 9 illustrate an exemplary operation of a container for discharging contents according to an embodiment of the present disclosure. More specifically, FIGS. 8 and 9 illustrate an operation in which a button portion is lifted in response to a separation operation of a dropper portion so that the contents can be suctioned into a pipette portion.

Here, as shown in FIG. 8, the guide groove 213 formed in the inner cap 210 may include a first groove 213*a* formed in a horizontal direction at an end in a second rotation direction, a second groove 213*b* inclined upward in the first direction from the first groove 213*a*, and a third groove 213*c* formed in the horizontal direction at an end in a first rotation direction.

According to an embodiment, the guide groove 213 is cut from (or passes through) one area of the second groove 213*b* and/or the third groove 213*c* to the upper end of the inner cap 210 so that a fourth groove 213*d* that facilitates assembly or separation of the button portions 240 and 250 and the inner cap 210 can further be formed. In addition, according to an embodiment, at least one locking jaw (reference numeral is not shown) may be formed so that the lifting protrusions 254 can deviate from the first groove 213*a* of the inner cap 210 only when the user applies a predetermined or more rotational force to one area of the first groove 213*a* and the third groove 213*c*.

First, referring to FIGS. 8A and 9A, in a state in which the dropper portion 200 is completely coupled to the container body 100, the lifting protrusions 254 of the button portions 240 and 250 are located in the first groove 213*a*, and the elastic member 250 is seated on the lower portion of the accommodation space 214. In this case, the seal cap 230 may be disposed adjacent to the upper end of the pipette portion 220 in the lower inner portion of the cylinder portion 211.

Subsequently, referring to FIGS. 8B and 9B, when the user rotates the outer cap 280 in the first direction to separate the dropper portion 200, the button portions 240 and 250 are rotated in the first direction together with the outer cap 280. In this case, the inner cap 210 maintains a stopped state, and the lifting protrusions 254 deviate from the first groove 213*a* of the inner cap 210 and move upward in the first direction along the second groove 213*b* so that the button portions 240 and 250 and the seal cap 230 are lifted together. Accordingly, changes in pressure occur in the cylinder portion 211 and the pipette portion 220, and the contents contained in the container body 100 are suctioned into the pipette portion 220. Meanwhile, in this case, the pressing portion 240 and the button cap 260 gradually protrude outward of the outer cap 280.

When the user continues to rotate the outer cap 280 in the first direction, the lifting protrusions 254 move upward to the end of the second groove 213*b* and are then accommodated in the third groove 213*c*. Thereafter, the lifting protrusions 254 come into contact with the end surface of the third groove 213*c* and press the end surface of the third groove 213*c* to transmit a rotational force to the inner cap 210, and the inner cap 210 rotates together with the outer cap 280 in the first direction. Thus, the inner cap 210 is separated from the discharge portion 110 of the container body 100 (i.e., the screw is released).

In this case, since the lower support 252 of the elastic member 250 is supported by the lifting protrusions 254 accommodated in the third groove 213*c*, the elastic member 250 may provide an elastic force in the upward direction with respect to the pressing portion 240.

On the other hand, when the user rotates the outer cap 280 in the second direction for coupling of the dropper portion 200, the lifting protrusions 254 operate in a direction opposite to the above direction, pass through the third groove 213*c* and the second groove 213*b*, and are accommodated in the first groove 213*a*. In this procedure, the button portions 240 and 250 and the seal cap 230 may be lowered. Thereafter, the lifting protrusions 254 come into contact with the end surface of the first groove 213*a* and press thereon to transmit the rotational force to the inner cap 210, and the inner cap 210 rotates in the second direction together with the outer cap 280 and thus is screw-coupled to the discharge portion 110 of the container body 100.

Figure 10:
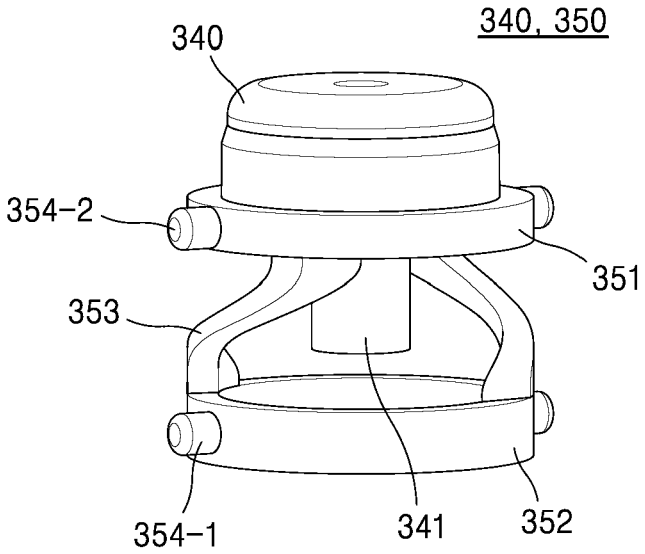
FIG. 10 is a perspective view for describing a button portion of a container for discharging contents according to an embodiment of the present disclosure.
Figure 11:
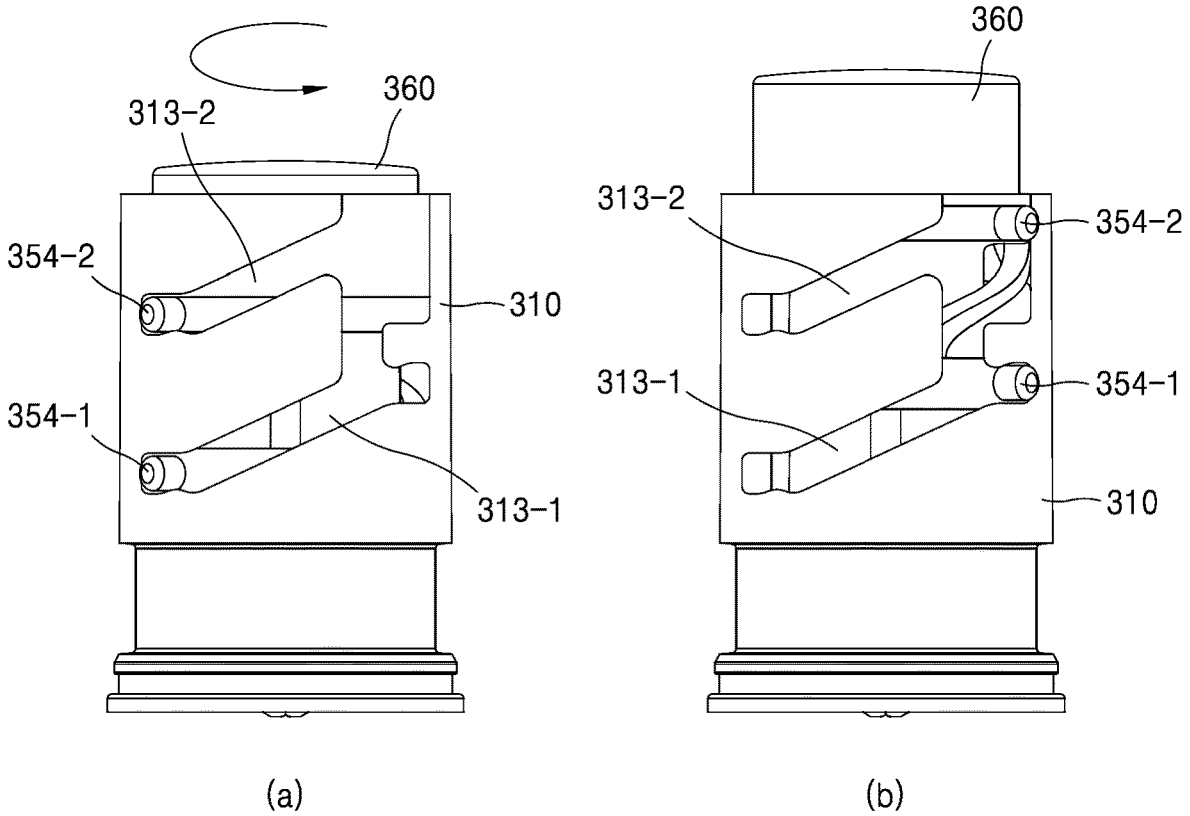
FIG. 11 illustrates an exemplary operation of a container for discharging contents according to an embodiment of the present disclosure.

FIG. 10 is a perspective view of a button portion according to an embodiment of the present disclosure, and FIG. 11 illustrates an exemplary operation of a container for discharging contents according to an embodiment of the present disclosure.

The same configurations in FIGS. 1 through 9 and FIGS. 10 and 11 are referred to as the same name, and differences between two embodiments will be described below.

Referring to FIGS. 10 and 11, the button portions 340 and 350 may include a first lifting protrusion 354-1 and a second lifting protrusion 354-2, which are formed on each of the lower support 352 and the upper support 351 of the elastic member 350. In this case, the first lifting protrusion 354-1 and the second lifting protrusion 354-2 may be formed at corresponding positions of the lower support 352 and the upper support 351 so as to be arranged in the vertical direction.

In addition, a first guide groove 313-1 and a second guide groove 313-2 having different formation positions may be formed in the inner cap 310 so that the first lifting protrusion 354-1 and the second lifting protrusion 354-2 are respectively inserted into the first guide groove 313-1 and the second guide groove 313-2.

When the user rotates the outer cap 280 in the first direction or in the second direction, the first lifting protrusion 354-1 and the second lifting protrusion 354-2 move respectively along the first guide groove 313-1 and the second guide groove 313-2, and thus the lifting or lowering of the button portions 340 and 350 may be performed.

On the other hand, the end of the second guide groove 313-2 in the first direction is cut fully in the vertical direction so that the user can press the pressing portion 340 when the button portions 340 and 350 are lifted.

In this way, the lifting protrusions 354-1 and 354-2 are formed on both the lower support 352 and the upper support 351 and move along different guide grooves 313-1 and 313-2, respectively, so that the lifting or lowering of the button portions 340 and 350 can be more stably performed and the pressing portion 240 is pressed by an external force and thus the contents can be prevented from being unintentionally discharged.

Figure 12:
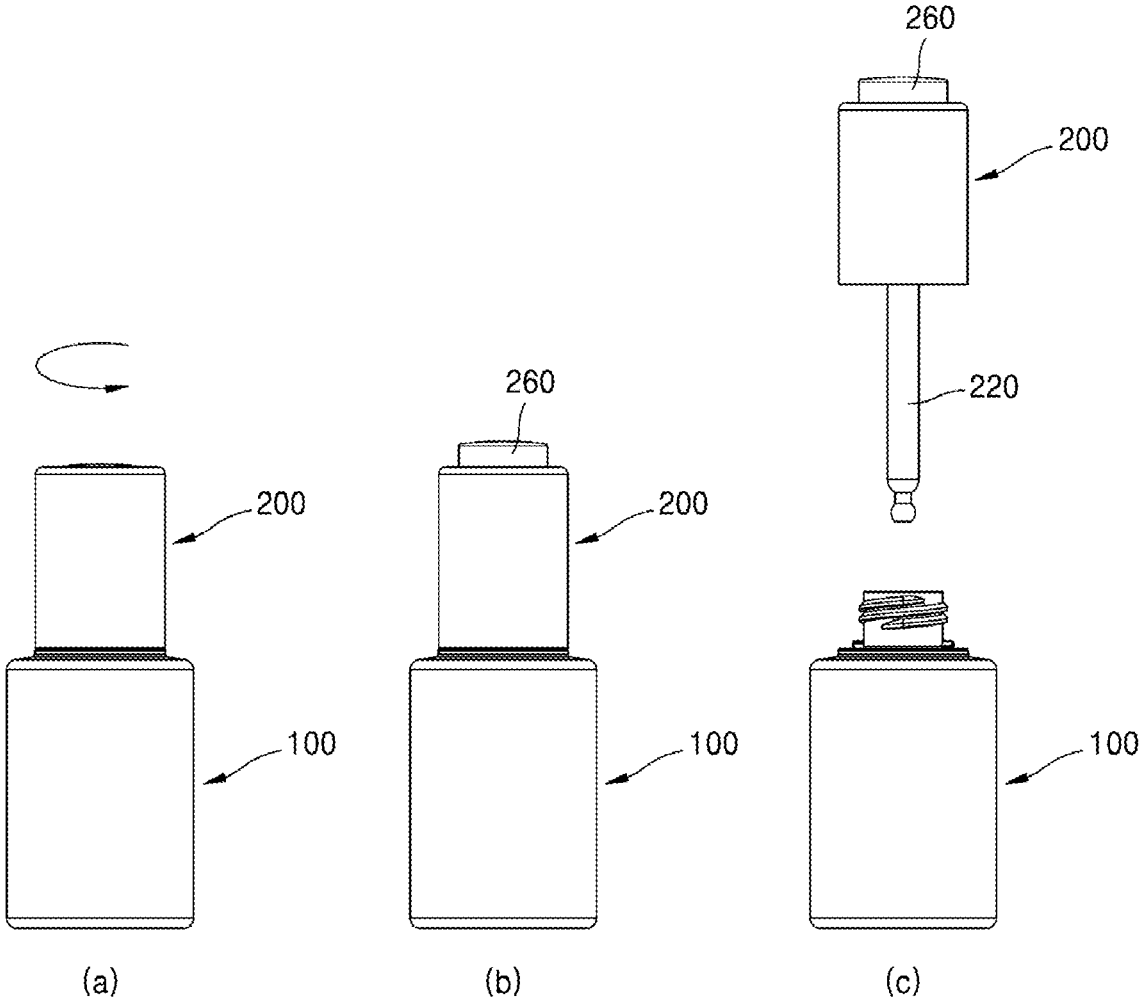
FIG. 12 illustrates an example of use of a container for discharging contents according to an embodiment of the present disclosure.

FIG. 12 illustrates an example of use of a container for discharging contents according to an embodiment of the present disclosure.

Referring to FIGS. 12A and 12B, in a state in which the dropper portion 200 is completely coupled to the container body 100, the user rotates the outer cap 280 in the first direction, and the pressing portion 240 and the button cap 260 protrude outward, and simultaneously, the contents are suctioned into the pipette portion 220, and the screw-coupling of the inner cap 210 may be released.

Next, referring to FIG. 12C, the user withdraws the pipette portion 220 from the container body 100 and presses the pressing portion 240 and the button cap 260 so that the contents suctioned into the pipette portion 220 can be discharged to an application site.

On the other hand, when the use of the contents is completed, the user inserts the pipette portion 220 back into the container body 100 and rotates the outer cap 280 in the second direction so that the pressing portion 240 and the button cap 260 can be accommodated inside the outer cap 280 and the inner cap 210 can be screw-coupled to the discharge portion 110 of the container body 100.

As described above, the optimal embodiments have been disclosed in the accompanying drawings and specifications. Although the specific terms have been used herein, these are only used for the purpose of describing the present disclosure and are not used to limit the meaning or the scope of the present disclosure described in the claims. Therefore, those of ordinary skill in the art will understand that various modifications and equivalent other embodiments are possible therefrom. Therefore, the true technical scope of the present disclosure should be determined by the technical spirit of the appended claims.

What is claimed is:

1. A container for discharging contents, comprising:
a container body configured to accommodate contents therein; and
a dropper portion detachably coupled to an upper portion of the container body and configured to suction and discharge the contents in the container body,
wherein the dropper portion comprises:
an inner cap detachably coupled to the upper portion of the container body;
a pipette portion coupled to the inner cap to communicate with an inside of the inner cap and having at least a part thereof accommodated in the container body to suction the contents;
a button portion; and
an outer cap that is coupled to surround the inner cap and rotates integrally with the button portion,
wherein the button portion comprises: a pressing portion configured to discharge the contents suctioned into the pipette portion by pressing; and an elastic member,
wherein the elastic member is formed under the pressing portion to be disposed inside the inner cap and provides an elastic force to the pressing portion,
wherein the elastic member is accommodated in an uncompressed state in the inner cap and integrally lifted with the pressing portion from the inside of the inner cap according to a separation of the dropper portion, at least a part of the pressing portion protrudes outward due to the lifting of the pressing portion, and the elastic member is compressed by a user pressing the protruding part of the pressing portion,
wherein at least one lifting protrusion is formed on the button portion,
wherein at least one guide groove, into which the at least one lifting protrusion is inserted, is formed to pass through the inner cap along an outer circumferential surface thereof, and
wherein when the outer cap is rotated in a first direction or a second direction opposite to the first direction in order to separate or couple the dropper portion from or to the container body, the at least one lifting protrusion moves along the at least one guide groove and the button portion is lifted or lowered.

2. The container of claim 1, wherein at least a part of the button portion is made of a soft plastic material, and the pressing portion and the elastic member are integrally formed.

3. The container of claim 1, wherein a cylinder portion that communicates with the pipette portion is formed inside the inner cap, and
wherein the dropper portion further comprises a seal cap that is coupled to the button portion, is pressed against an inner circumferential surface of the cylinder portion, and is lifted or lowered according to the separation or coupling of the dropper portion to change an internal pressure of the cylinder portion.

4. The container of claim 1, wherein the elastic member comprises:
an upper support connected to the pressing portion;
a lower support provided under the upper support; and
at least one elastic portion connecting the upper support and the lower support with a certain inclination and is bent and deformed when the pressing is performed on the pressing portion.

5. The container of claim 4, wherein the at least one lifting protrusion is formed on the lower support or on each of the lower support and the upper support.

6. The container of claim 5, wherein, when the user presses the pressing portion to discharge the contents, the lower support is supported by the at least one lifting protrusion and the at least one guide groove and the elastic member provides the elastic force to the pressing portion.

7. The container of claim 1, wherein a vertical groove is formed on an inner surface of the outer cap in a vertical direction, and
wherein an end of the at least one lifting protrusion passing through the at least one guide groove is coupled to the vertical groove and a rotational force of the outer cap is transmitted to the button portion.

8. The container of claim 1, wherein, when the at least one lifting protrusion comes into contact with an end of the at least one guide groove in the first direction according to a rotation of the outer cap in the first direction, the inner cap is rotated together with the outer cap in the first direction and is separated from the container body.

9. The container of claim 1, wherein, when the at least one lifting protrusion comes into contact with an end of the at least one guide groove in the second direction according to a rotation of the outer cap in the second direction, the inner cap is rotated together with the outer cap in the second direction and is coupled to the container body.

10. The container of claim 1, wherein, as the inner cap is rotated together with the outer cap in the second direction, the inner cap is coupled to the container body, wherein at least one limiting protrusion is formed on an inner lower end of the inner cap, wherein at least one limiting jaw is formed on an upper surface of the container body, and wherein when a lower end of the inner cap becomes closer to the upper surface of the container body at a certain interval, the at least one limiting protrusion is caught by the at least one limiting jaw and the rotation of the outer cap and the inner cap in the second direction is limited.

* * * * *